US005285991A

United States Patent [19]

Carlson

[11] Patent Number: 5,285,991

[45] Date of Patent: * Feb. 15, 1994

[54] CARD TABLE MOUNTED FOOD AND BEVERAGE HOLDING APPARATUS

[75] Inventor: Arthur E. Carlson, 4444 W. Point Loma Blvd., #6, San Diego, Calif. 92107

[73] Assignee: Arthur E. Carlson

[ * ] Notice: The portion of the term of this patent subsequent to Dec. 8, 2009 has been disclaimed.

[21] Appl. No.: 940,620

[22] Filed: Sep. 4, 1992

Related U.S. Application Data

[63] Continuation-in-part of Ser. No. 701,473, May 16, 1991, Pat. No. 5,169,108.

[51] Int. Cl.[5] ..... A47K 1/09

[52] U.S. Cl. ..... 248/311.2; 248/230; 248/315

[58] Field of Search ..... 248/311.2, 314, 315, 248/309.1, 310, 312, 231.8, 230; 108/24, 25, 26; 297/88; 220/475

[56] References Cited

U.S. PATENT DOCUMENTS

| | | | |
|---|---|---|---|
| 2,614,782 | 10/1952 | Jackson | 248/221 |
| 2,703,277 | 3/1955 | Henschel | 311/103 |
| 2,706,138 | 4/1955 | Luce et al. | 311/77 |
| 2,982,982 | 5/1961 | Swiff, Sr. | 248/311.2 X |
| 2,995,333 | 8/1961 | Pazzano | 248/311.2 X |
| 3,021,106 | 2/1962 | Kramer | 248/226 |
| 3,131,899 | 5/1964 | Luhrs | 108/26 X |
| 3,270,694 | 9/1966 | Wallace | 108/26 |
| 3,784,142 | 1/1974 | O'Brien | 248/311.2 |
| 4,099,470 | 7/1978 | Cannon, Jr. | 108/26 |
| 4,131,259 | 12/1978 | Franks | 248/311.2 |
| 4,560,128 | 12/1985 | Willeby | 248/230 |
| 4,799,638 | 1/1989 | Allen | 248/311.2 |
| 4,844,399 | 7/1989 | Harm | 248/311.2 |
| 4,871,141 | 10/1989 | Chen | 248/231.8 X |
| 4,878,642 | 11/1989 | Kirby, Jr. | 248/311.2 |
| 4,887,784 | 12/1989 | Kayali | 248/311.2 |
| 4,997,156 | 3/1991 | Allen | 248/314 X |
| 5,014,956 | 5/1991 | Kayaly | 248/311.2 |
| 5,070,795 | 12/1991 | Redlin | 108/26 |
| 5,169,108 | 12/1992 | Carlson | 248/311.2 |

*Primary Examiner*—Ramon O. Ramirez

*Attorney, Agent, or Firm*—Baker, Maxham, Jester & Meador

[57] ABSTRACT

A food and/or beverage holding system for mounting on a card table having a card table leg assembly. The system includes a food or beverage holder mounted radially to a base sized to separate the holder far enough from a hook extension, for sanitary reasons, the base being mounted radially from its other end to a table leg receptacle for providing vertical stability, and from the base or table leg receptacle, the hook extends axially upwardly therefrom for removable attachment to one or more table leg lateral projections. The food and/or beverage holding system may be removably constructed for separating one or more major members from the remainder of the apparatus, to enhance portability.

21 Claims, 11 Drawing Sheets

FIG. 1
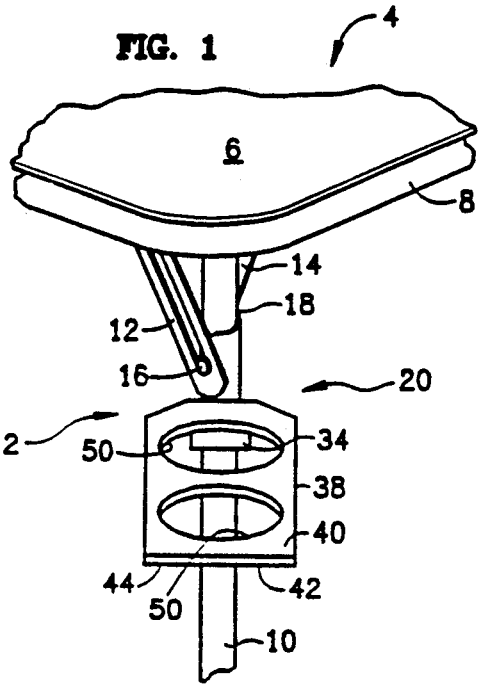
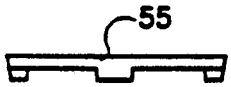
FIG. 4A
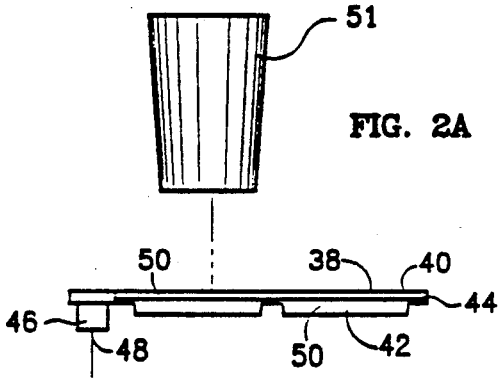
FIG. 2A
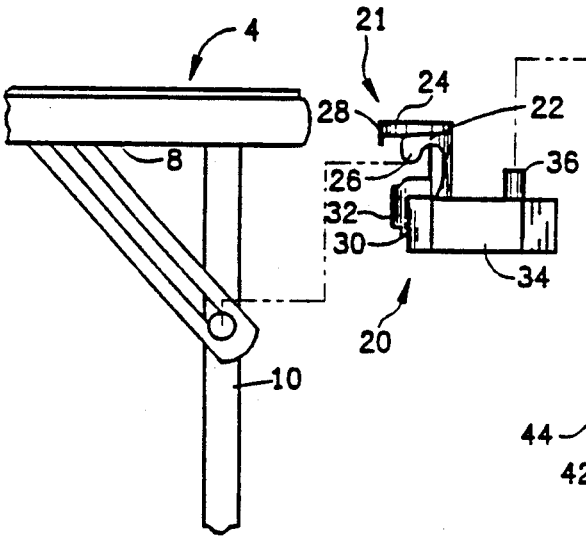
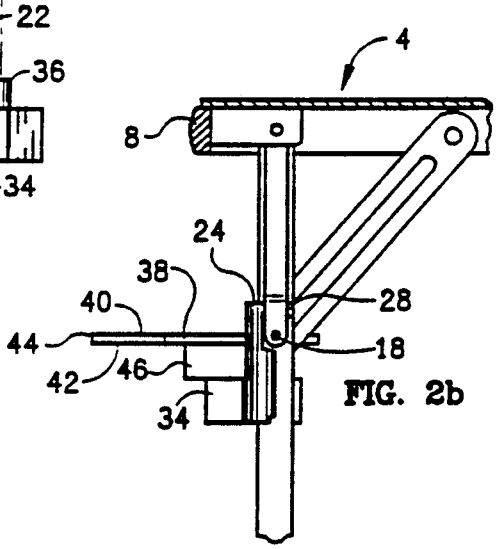
FIG. 2b
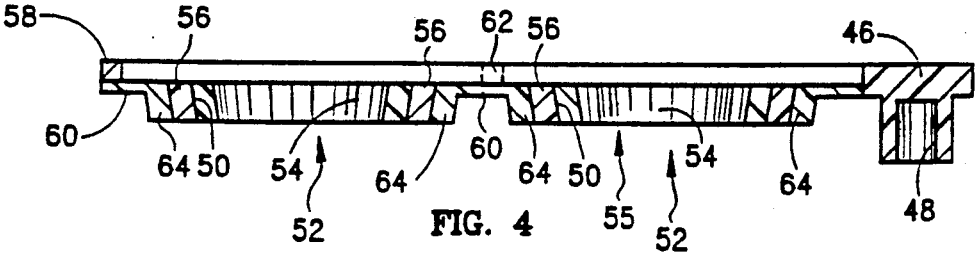
FIG. 4

FIG. 5
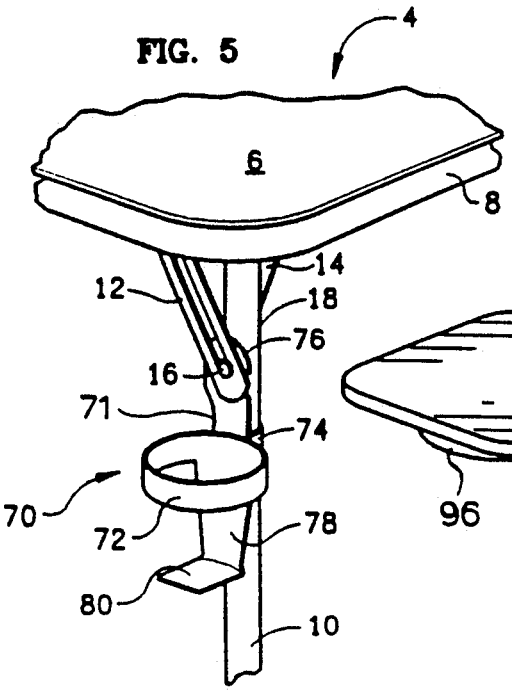
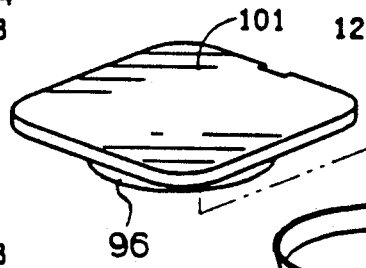
FIG. 6
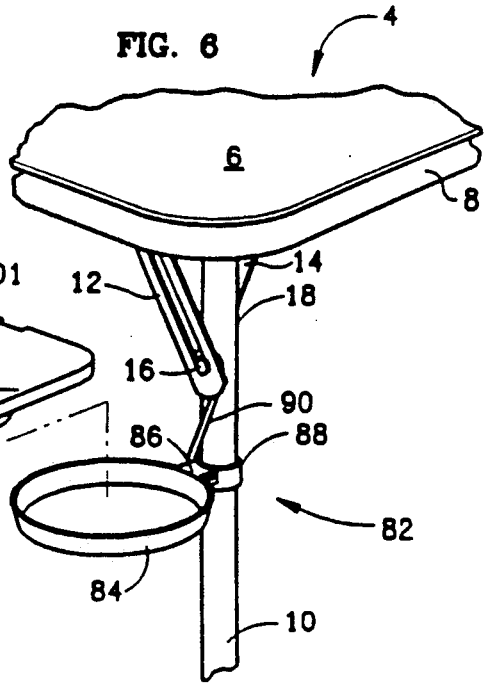
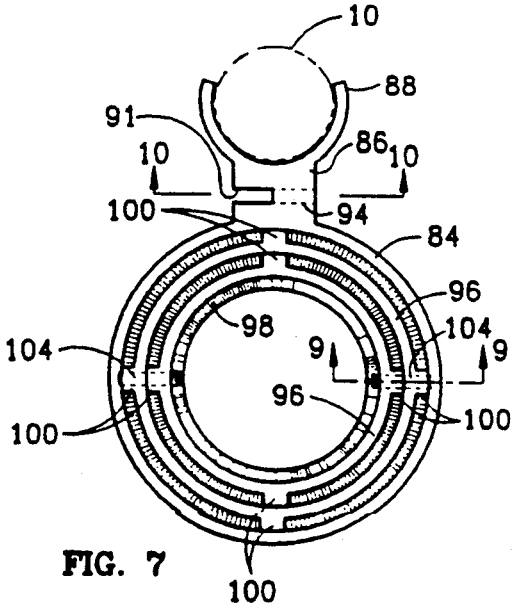
FIG. 7
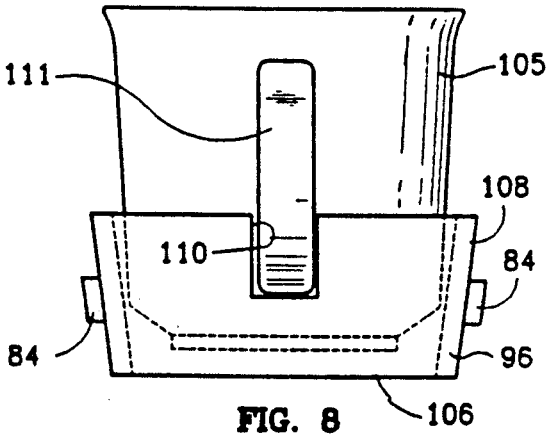
FIG. 8
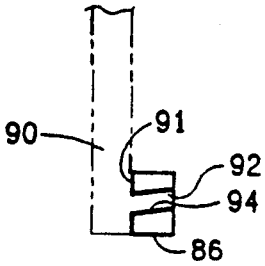
FIG. 10
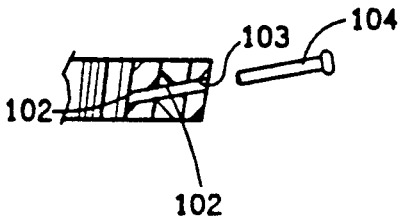
FIG. 9

FIG. 15
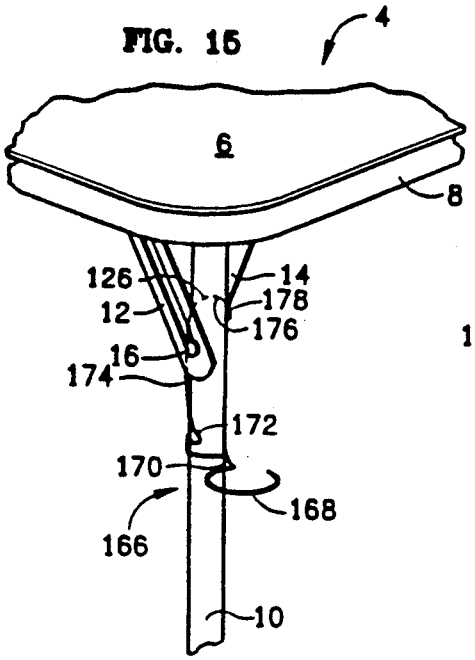
FIG. 18
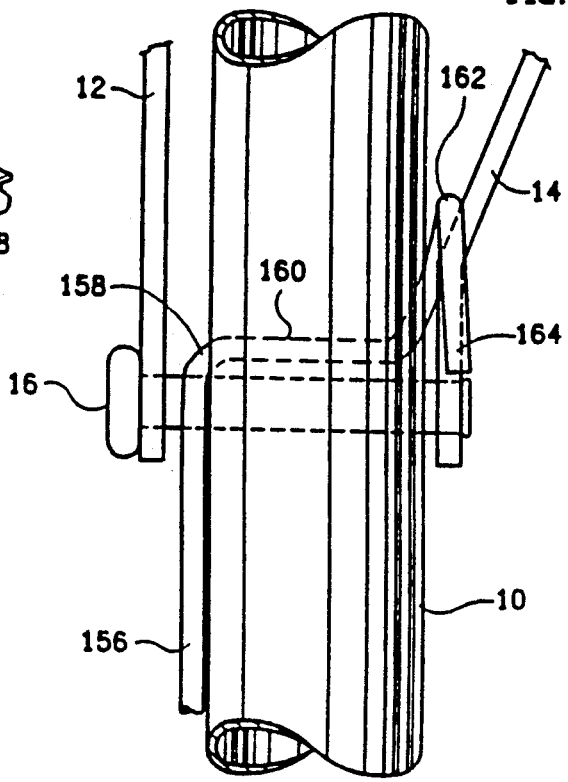
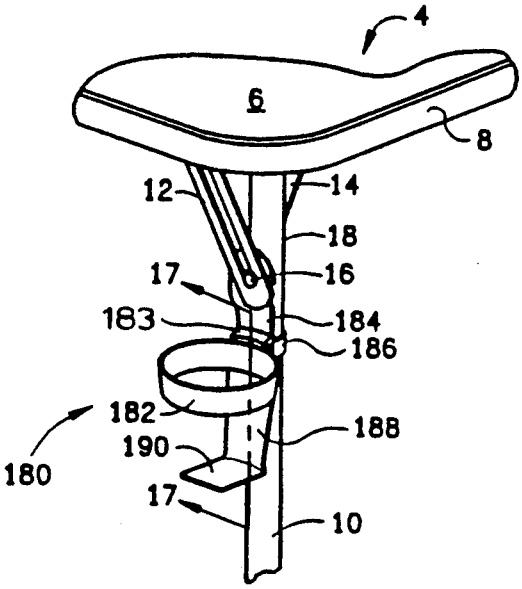
FIG. 16
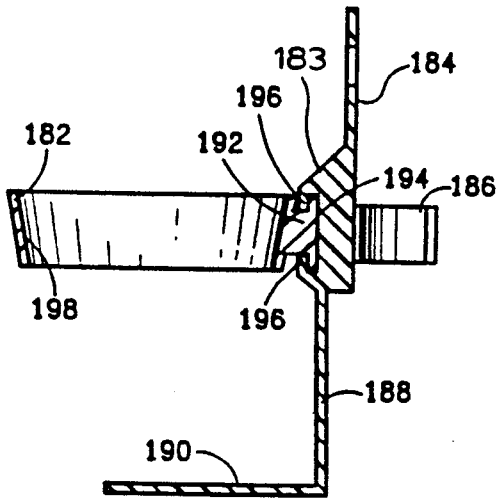
FIG. 17

CARD TABLE MOUNTED FOOD AND BEVERAGE HOLDING APPARATUS

RELATED APPLICATIONS

The present application is a continuation-in-part of application Ser. No. 07/701,473 filed on May 16, 1991, now U.S. Pat. No. 5,169,108.

BACKGROUND OF THE INVENTION

The field of the present invention is card table mounted food and beverage holding apparatus.

Folding tables for playing cards and other games are sized and configured to seat a number of persons around the table and include a smooth planar plane area accessible by each of the players. Such tables generally have four legs which are positionable between a stowage position and an open playing position. Typical card tables include a slotted brace member and a pivotable strut member for supporting each leg in the open position.

Because card games are often of fairly long duration, players often consume food and beverages, or smoke cigarettes, while playing. Because the table playing surface area is fairly limited, the placement of consumables on the table can result in spillage or other damage to the cards and the table.

Accordingly, it would be desirable to provide a holder for supporting food and beverages consumed by players at a card table which is readily accessible to the players but which eliminates the possibility of spillage and other damage. It would be further desirable to provide a food and beverage holder which can be readily removed from the table and transported with a player from one site to another. Relatedly, the food and beverage holder should not interfere in any way with table stowage following card play.

SUMMARY OF THE INVENTION

It is therefore the primary object of the present invention to provide a food and beverage holder for a card table directed to the foregoing objects and advantages. To that end, a removable card table mounted food and beverage holder may include in a preferred aspect a food or beverage holding member radially connected to a base, with the other end of said base connected to a table leg receptacle and being connected to a rising extension which ends with a hook for connection to one or more of the table leg support structures.

BRIEF DESCRIPTION OF THE DRAWINGS

FIG. 1 is a prespective view of a food and beverage holder constructed in accordance with the present invention as it would appear mounted on a collapsable card table.

FIG. 2A an exploded side elevation view of the food and beverage holder of FIG. 1 showing a cup to be held thereby.

FIG. 2B a reverse angle elevation view of the beverage holder of FIG. 2A.

FIG. 4 is a cross-sectional view taken along line 4—4 in FIG. 3.

FIG. 4A is an end view of an insert adapted for use with the food and beverage holder of FIG. 1.

FIG. 5 is a perspective view of a food or drink holder constructed in accordance with another aspect of the present invention as mounted on a collapsable card table.

FIG. 6 is a perspective view of a food or beverage holder constructed with still another aspect of the present invention as mounted on a collapsable card table.

FIG. 7 is a plan view of the food or beverage holder of FIG. 6.

FIG. 8 is a side elevation view of a beverage holding insert for the food or beverage holder of FIG. 6 shown with a beverage mug and supported therein.

FIG. 9 is a detailed cross-sectional view taken along line 9—9 in FIG. 7.

FIG. 10 is a detailed cross-sectional view taken along line 10—10 in FIG. 7.

FIG. 15 is a perspective view of a food or beverage holder constructed in accordance with still another aspect of the present invention as mounted on a collapsable card table.

FIG. 16 is a perspective view of a food or beverage holder constructed in accordance with still another aspect of the present invention as mounted on a collapsable card table.

FIG. 17 is a detailed cross-sectional view taken along line 17—17 in FIG. 16.

FIG. 18 is a detailed side-elevation view of the food or beverage holder, of FIG. 14.

DESCRIPTION OF THE PREFERRED EMBODIMENTS

Figure 3:
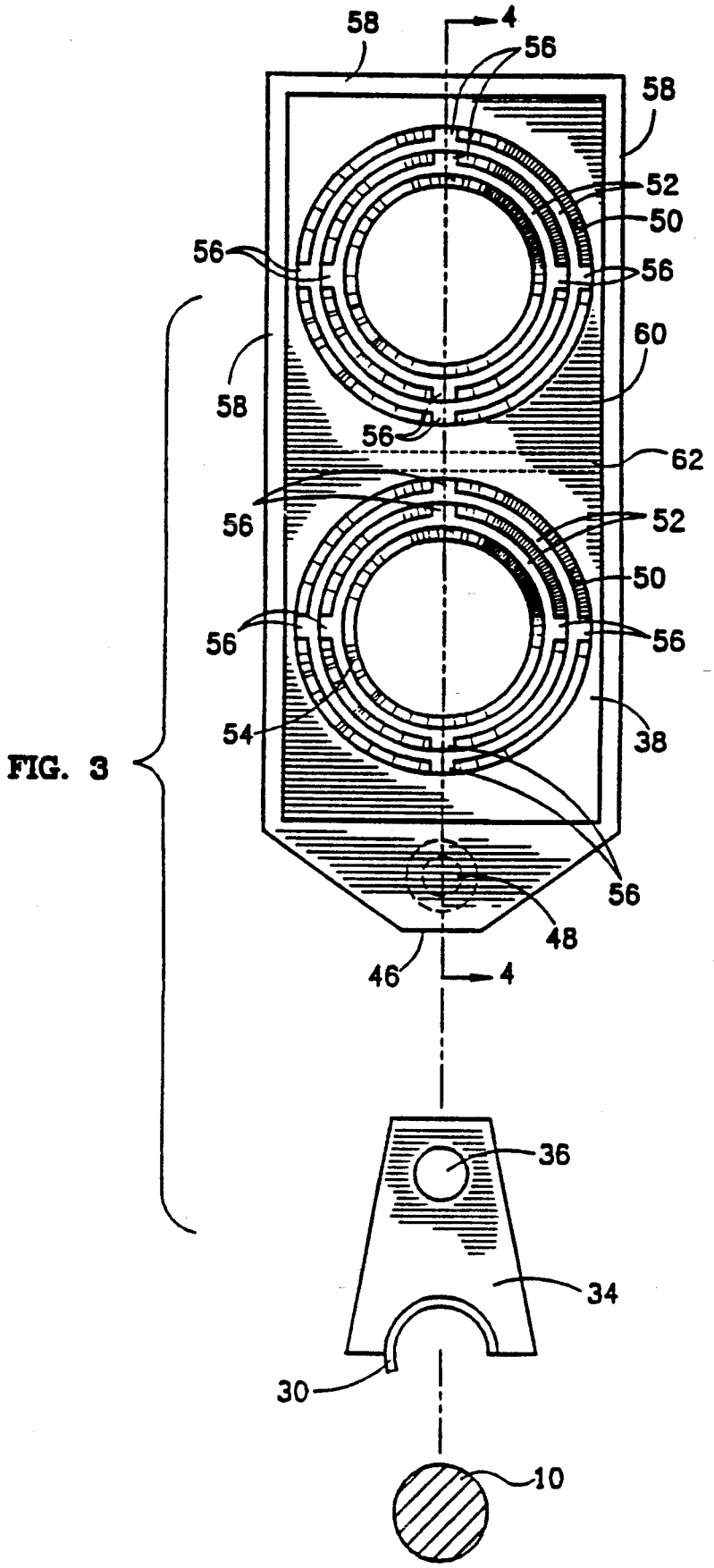
FIG. 3 is a plan view of a portion of the food and beverage holder of FIG. 1.

With reference now to FIGS. 1 and 2A, 2B, a food or beverage holder 2 is shown as being mounted on a collapsable card table 4, which is set up in playing position. The collapsable card table 4 includes a generally planar table top 6 having a peripheral railing 8. Extending generally perpendicularly and downwardly from the underside of the table top 6 is a table leg assembly including a leg 10, which is one of four legs used to support the table top 6 in an upright, horizontal playing position. The table leg 10 is stablized and supported in the open position by means of a slotted support 12 and a stablizing strut 14. The table leg 10 is slidably disposed in the slotted support 12 by means of a laterally extending projection 16 having an enlarged end portion that is spaced laterally from the table leg 10. Typically, the projection 16 would be formed from a bolt having a rivet-like head. The lower end of the slot formed in the slotted support 12 is an enlarged circular opening whose diameter is larger than the width of the slot. The projection 16 extending from the table leg 10 includes an area of enlarged diameter disposed inside the enlarged end portion which engages the circular opening so as to lock the table leg 10 and slotted support 12 in a secured relation. The upper end of the slotted support 12 is pivotally mounted to the underside of the table top 6. To collapse the table leg 10, the slotted support 12 is pressed toward the leg so that the enlarged slot end disengages from the enlarged diameter section of the projection 16, whereupon a smaller diameter section of the projection 16, adjacent the table leg 10, can be slidably translated through the slot in the slotted support 12.

The stablizing strut 14 is pivotally mounted at one end to the underside of the table top 6, and at the other end to the table leg 10, on the side opposite the projection 16. Typically, the stablizing strut is mounted to the table leg 10 somewhat above the level of projection 16. The stablizing strut 14 is partially attached to the table leg 10 by means of a rivet or other suitable fastener 18.

In the configuration of FIGS. 1 and 2A, 2B, the slotted support 12 is positioned to the right side of a player seated at the side of the card table 4 to which the slotted support 12 is attached. In some table configurations, the slotted support 12 is positioned on the player's left. It should be understood and appreciated that the food and beverage holders now to be described could be readily adapted to both configurations, or to other table configurations conventionally used.

The food or beverage holder 2 includes an attachment at 20 with arms 30 and 32 forming a table leg receptacle of generally cylindrical shape but open on one side to mount over the table leg 10. The arms 30 and 32 of the table leg receptacle extends more than 180 degrees around the table leg 10 and is in non-grasping engagement with the table leg 10. The attachment has a hook or two hooks which extend upwardly from the attachment at 20 and are adapted for mounting onto two table leg lateral projections, bolt 16 and strut 14. To that end, the hooks include a first cutout therein forming a arm 22 and a diametrically opposed cutout forming a arm 24. The arm 22 is sized to engage the table leg projection 16. The arm 24 is slightly wider and is sized to engage the stablizing strut 14. The arms 22 and 24 terminate at opposing attachment hooks 26 and 28, respectively. A variation is where there is no arm 24 and it does not mount onto strut 14 but arm 26 mounts on projection 16. Relatedly, the inside diameter of the table leg receptacle made by the arms 30 and 32 is slightly larger than the diameter of the table leg 10 thus guaranteeing that the table leg receptacle does not have a grasping hold on table leg 10. The components of attachment 20 and 21 are preferably formed from resilient plastic or the like so that the attachment hooks 26, 28 and arms 30, 32, when they exceed 180 degrees, may be flexed outwardly as the food or beverage holder 2 is engaged or disengaged with the table leg 10.

The table leg attachment 20 is integral with the base 34 which extends radially away from the table leg receptacle at 20 and toward the platform 38. The base 34 includes a pivotal connection 36 mounted adjacent one end thereof and extending vertically therefrom. The pivotal connection 36 is used to mount the base 34 to a food or beverage holding platform 38 at 46. The food or beverage platform 38 includes an upper surface 40, a lower surface 42, a plurality of sides 44 and a connection stem 46 disposed at one end thereof. The connection stem 46 has formed therein a cylindrical recess 48 sized and adapted to receive the pivotal connection 36 of the base 34. The food or beverage holding platform 38 further includes a pair of cupholding aperatures 50 that are sized and adapted to receive a beverage container 51. The foregoing components could be made from a variety of materials but are preferably formed from resilient plastic having sufficient strength to bear the weight of food and beverages without excessive deformation or instability. The base 34, referred to above, is located between the beverage holding platform 38 and the table leg attachment 20. One of its functions is to separate those adjoining members by adequate space so the drinking ring of the beverage container will not contact the hook extensions of the table leg attachment 20 or the slotted support 12 during normal use.

In operation, the food or beverage holding platform 38 can be used to hold a beverage container 51 for each of two players, one sitting on either side of the table leg 10. The players can pivot the holding platform 38 with respect to the table leg attachment 20 so as to have better access to the supported beverage.

Referring now to FIGS. 3 and 4, the food or beverage platform 38 may be adapted to support beverage and containers of varying size using one or more nested inserts 52. Each insert 52 includes an annular ring portion having an interior beverage container support surface 54 tapering downwardly and inwardly from the top of the retainer 52. The nested retainers 52 further include four radially extending spacers 56 positioned on the exterior of the annular ring portion of the retainers. The spacers 56 are sized to engage the innersurface 54 of the next larger spacer ring 52 or the aperature 50 of the food or beverage platform 38, depending on the size of the retainer ring 52.

As further shown in FIG. 3, the food or beverage holding platform 38 may include a perimeter wall 58 extending around a central web 60. In addition, there may be provided a central flange 62 that divides the holding platform 38 into two compartments. As further shown in FIG. 4, the food or beverage holding aperatures 50 in the holding platform 38 are formed by a pair of flanges 64 extending downwardly and inwardly from the web 60.

Shown in FIG. 4A is an insert 55 to fill the space between the pair of flanges 64 furthest from recess 48 of FIG. 4, with its top surface flush with web 60 for holding cookies, ash tray, etc., for the situation when all four table legs 10 have a food or beverage holder 2 and each of the four players only needs one aperture for a beverage. The lower perimeter wall portions of insert 55 preferably extend down as far as possible as the wall 64 of the receptacle 50 for proper seating. Moreover, the top circular surface of insert 55 is preferably as thick as and is flush with the top of the web 60 of the holding platform 38.

Turning now to FIG. 5, a beverage holder 70 is shown mounted on the collapsable card table 4 of FIG. 1. The beverage holder 70 includes a base 71 and a generally ring shaped beverage container receptacle 72 mounted to the base 71, the axial and radial geometry of which shall be used in reference to the remaining components of the holder 70. A table leg receptacle 74 is mounted to and extends radially away from the base 71 to encompass a portion of the card table leg 10. The table leg receptable 74 extends partially around the table leg 10 for a distance slightly more than 180 degrees, and has an inside diameter slightly in excess of the outside diameter of the table leg 10 to provide engagement therewith. As in the case of the food or beverage holder 20, the beverage holder 70 is preferrably made from resilient plastic material. The receptacle 74 thus is deformable as the receptacle is engaged or disengaged with the table leg. The beverage holder 70 further includes an attachment hook 76 extending axially upwardly from the base 71 for engaging the projection 16 extending laterally from the card table leg 10. Preferrably, the attachment hook 76 is curved to conform to the outside curvature of the table leg 10. The beverage holder 70 is completed by a leg member 78 extending axially downwardly from the base 71, and a beverage container support foot 80 extending radially away from the leg member 78, toward the axis of the beverage container receptacle 72.

Referring now to FIG. 6, another beverage holder 82 is shown mounted on the table 4 of FIG. 1. The beverage holder 82 includes a generally ring-shaped beverage container receptacle 84, the axial and radial orientation of which shall be used in reference to the remaining components of the holder 82. The beverage container receptacle 84 is integrally formed with base 86 and table leg receptacle 88 extending radially away from the base 86 for encompassing slightly more than 180 degrees of the card table leg 10. Extending upwardly from the base 86, is an attachment hook 90 for engaging from its left or right side the projection 16 extending laterally from the card table leg 10. As shown in FIG. 10, the attachment hook 90 at its bottom end is received in a slot 91 in the base 86 and includes an engagement pin 92 extending laterally and slightly upwardly from a position near the bottom of the hook 90. The engagement pin 92 is sized and adapted to engage a mating receptacle 94 extending from the right side of the slot 91 to the right side of the base 86 of the beverage holder 82. Thus, these integral parts of the beverage container receptacle 84, the table leg receptacle 88 and base 86 can be disengaged from the attachment hook 90, as shown in FIGS. 7 and 10, for convenient transport, storage of the holder and simplification of dies for plastics molding of holder 82.

Referring now to FIGS. 7 and 8, the beverage holder 82 may include a plurality of nested adapter rings 96 which are identical in design to the adapter rings 52 described above. Thus, the adapter rings 96 include an annular body portion having an interior surface 98 extending downwardly and inwardly from the top of the annular body portion to support a beverage container. Extending radially outwardly from the annular body portion of the adapter rings 96 are four spacers 100. These spacers 100 are sized to nest within the interior of the beverage container receptacle 84 or the interior face 98 of the next larger adapter ring 96, depending on the size of the ring 96. As shown in FIG. 6, the adapter ring 96 could be provided with an upper support tray 101. The support tray 101 could be provided in a variety of shapes and sizes, but preferably should be large enough relative to the ring 96 to extend over and beyond the beverage container receptacle 84 to adapt the beverage holder 82 for supporting food, ashtray, or other items in addition to a beverage.

To help secure the adapter rings 96 in position within the beverage container receptacle 84, the rings are provided with coincident radially extending apertures 102 which may be coincidentally aligned to receive a locking pin 104 with handle at its end for removal and to prevent it from entering too far, as shown in FIG. 9. As shown, the beverage container receptacle 84 includes a similar radially extending aperature 103 for receiving the locking pin 104. The foregoing components of the beverage holder 82 are preferably formed from suitable strength resilient plastic.

As shown in FIG. 8, one of the nested adapter rings 96 may be elevationally elongated to provide support for a mug 105. In that case, the adapter ring 96 would further include a generally frustoconical (or annular) wall 108 having a notch 110 formed therein to receive the mug handle 111.

Figure 11:
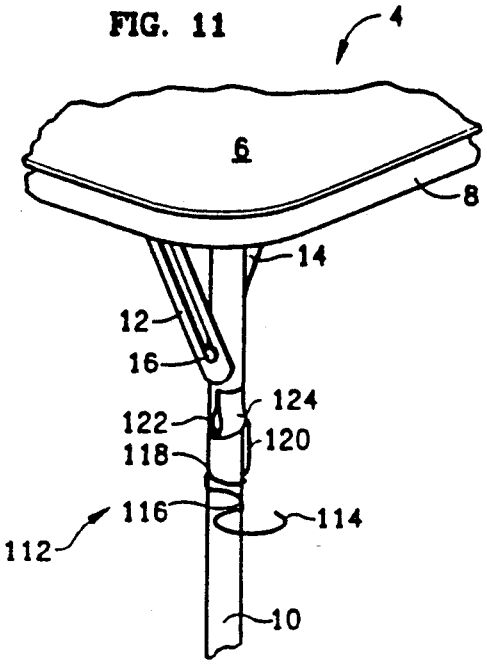
FIG. 11 is a perspective view of a food or beverage holder constructed in accordance with still another aspect of the present invention as mounted on a collapsable card table.

The beverage holders of FIGS. 11, 12, 13, 14, and 15 are shown as though the beverage containers, when in use, would be 25 degrees to 40 degrees to the right of bolt 16 and slotted support 12. In drawing these figures, the characteristics of the beverage holders were of primary concern. In actual use, the perpendicular centerlines of these beverage holders would extend down from bolt 16 so the beverage containers would be as convenient as possible to a card player's right hand. Turning now to FIG. 11, a beverage holder 112, which may be made from steel or the like, is shown mounted on the card table 4. The beverage holder 112 includes a ring-shaped beverage container receptacle 114 extending from a base 116. Also extending from the base 116, opposite the beverage container receptacle 114, is a table leg receptacle 118. The table leg receptacle 118 is adapted to fit snugly around the table leg 10 and extends more than 180 degrees around the table leg so as to provide an attachment therewith. Extending upwardly from the receptacle 118 is a vertical extension 120 extending to a hook 122. The hook 122 is curved to extend partially around the table leg 10 and is adapted to be received in a supporting loop 124 mounted to the table leg 10. If the beverage holder 112 is formed from steel and provides the aforementioned structural aspects, it will then have to be treated to obtain the resiliency required. The support loop 124 is preferably a strip of material folded over on itself to form the loop. The loop 124 is adhered on one side to the table leg 10, directly below the bolt 16.

Figure 12:
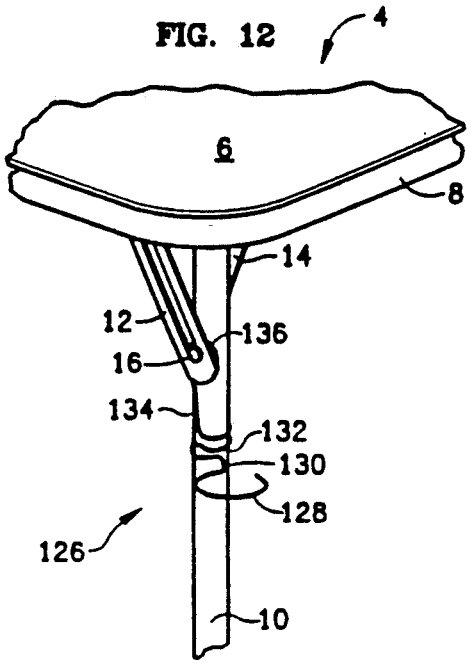
FIG. 12 is a perspective view of a food or beverage holder constructed in accordance with still another aspect of the present invention as mounted on a collapsable card table.

Turning now to FIG. 12, a beverage holder 126, made from steel or the like, is mounted on the card table 4. The beverage container 126 includes a lower beverage container receptacle 128 attached to a base 130. Extending from the base 130, opposite the beverage container receptacle 128, is a table leg receptacle 132. The table leg receptacle 132 is similar to the receptacle 118, previously described. Extending upwardly from the receptacle 132 is a vertical extension 134 extending to a hook 136 that is sized and adapted to engage the lateral projection 16 of the table leg 10. The beverage holder 126 may be formed from steel to provide the aforementioned characteristics and is then treated to provide the resiliency desired.

Figure 13:
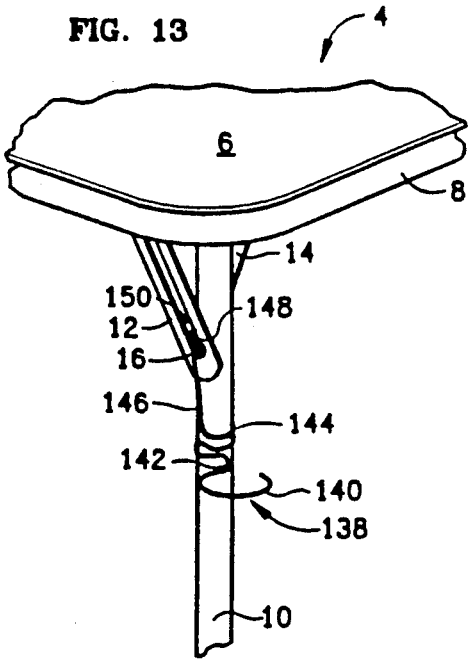
FIG. 13 is a perspective view of a food or beverage holder constructed in accordance with still another aspect of the present invention as mounted on a collapsable card table.

Referring now to FIG. 13, a beverage holder 138, made from steel or the like, includes a lower beverage container receptacle 140 attached to a base 142. Extending from the base 142, opposite the beverage container receptacle 140, is a table leg receptacle 144 which is similar to the table leg receptacle 132 previously described. Extending upwardly from the table leg receptacle 144 is an upward extension 146 extending to a hook 148. The hook 148 is sized and adapted to fit through the slot in the slotted support member 12 of the table 4 and includes an enlarged loop end portion 150 to prevent the beverage holder 138 from disengaging from the table 4. Holder 138 may be formed from steel after which it will be treated to provide the resiliency desired.

Figure 14:
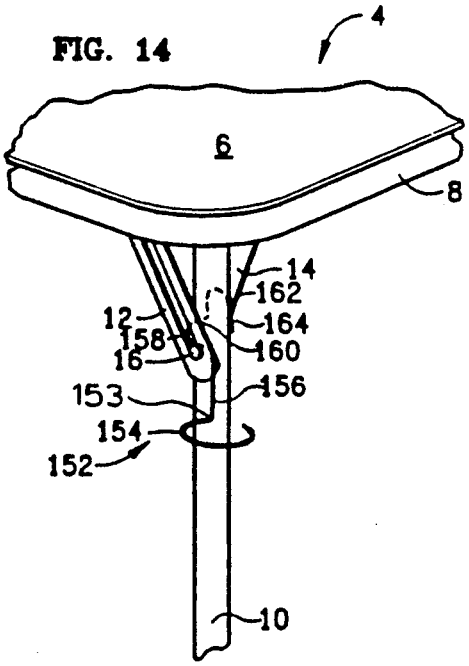
FIG. 14 a perspective view of a food or beverage holder constructed in accordance with still another aspect of the present invention as mounted on a collapsable card table.

FIG. 14 shows a beverage holder 152, also made from steel or the like, mounted on the card table 4. The beverage holder 152 has a lower beverage container receptacle 154 with a base 153 extending radially therefrom to meet the bottom of an upward extension 156. Extending upwardly from the base 153 is the upward extension 156 passing the right side of the lateral projection 16, then turning left into a shoulder 158. The shoulder 158 is sized and adapted to rest atop the lateral projection 16. Extending from the shoulder 158 is a horizontal table leg receptacle 160 that is sized and adapted to wrap around the left side of table leg 10 at a location above the lateral projection 16. The table leg receptacle 160 includes a second vertical extension 162 that engages the support strut 14 by means of a hook 164. Holder 152 may be formed from steel, after which it will be treated to provide the resiliency desired. FIG. 18 is an enlarged view of a portion of the above and is discussed in more detail below.

Referring now to FIG. 15, a beverage holder 166, made from steel or the like, is mounted to the card table 4. The beverage holder 166 includes a lower beverage container receptable 168 mounted to a base 170. Also mounted to the base 170, opposing the beverage container receptacle 168, is a table leg receptacle 172. Extending vertically upwardly from the table leg receptacle 172 is an upward extension 174 passing to the left of bolt 16 and transitioning to an upper shoulder 176. The shoulder 176 is sized and adapted to wrap about one half way around the table leg 10 on the left side and includes a hook 178 that is sized and adapted to engage the support strut 14 of the table 4. After being formed as mentioned, a steel holder 166 would be treated to provide the resiliency required.

Referring now to FIG. 16 and 17, a beverage holder 180 is mounted to the collapsable card table 4. The beverage holder 180 is similar in some respects to the beverage holder 70 except that the beverage container receptacle 182 is removably mountable to a base 183 which is attached on its other side to a table leg receptacle 186, and to the upwardly extending hook 184. The receptacle 182 tapers downwardly and inwardly at an angle similar to that of the containers holder 180 is designed to receive. Otherwise, the beverage holder 180 includes a table leg receptacle 186 extending outwardly from the base 183. A lower vertical extension 188 from the base 183 connects with the horizontal beverage container support member 190. The beverage container receptacle 182 includes a stem 192 extending radially outwardly therefrom having an attachment tab 194 thereon. The table leg attachment hook includes a pair of upper and lower opposing arms 196 spaced to secure the attachment tab 194 for removable attachment therebetween by radially rotating the beverage container receptacle 182 to slidably bring the attachment tab 194 in and out of engagement with the opposing arms 196. As shown, the beverage container receptacle 182 may have an interior face 198 that extends downwardly and inwardly from the top of the receptacle 182 to provide enhanced support for a beverage container. By having three removable beverage container receptacles 182 of increasingly bigger diameters, an assortment of tapered plastic or paper beverage containers can be held which have capacities ranging from 6 to 15 ounces. An equally useful variation to the above-described stem 192 which extends radially outwardly from the beverage container receptacle 182 follows. The stem 192 could be straight side to side, being perpendicular to a line passing from a line which starts at the outermost point of container 182, then through the center of receptacle 182 and to the center of the base 183 and the stem would be slidable in a straight tunnel-like opening extending from one side of the base 183 to the other. The base 183 would have a pair of upper and lower opposing arms 196 spaced to secure the attachment tabs 194, for removable attachment therebetween by sliding stem 192 through the straight tunnel-like opening in the base 183. The base 183 should be sized large enough so that its separation of the container receptacle 182 from the table leg receptacle 186 is sufficient so that the drinking ring of a large tapered cup during actual use, does not, with normal care, contact the hook 184, its lower extension or the table leg slotted support 12, for sanitary reasons. In other respects, this variation would be like beverage holder 180 described above.

FIG. 18 is an enlarged view of FIG. 14 with respect to reference numbers 156, 16, 158, 160, 162, 14 and 164. As shown, the first upward extension 156 passes over the lateral projection 16 and transitions to a shoulder 158, which rests on top of the projection 16. The shoulder 158 transitions to a partial table leg receptacle 160, which in turn includes a second upward extension 162 terminating at the hook 164, engaging the strut 14.

Figure 19:
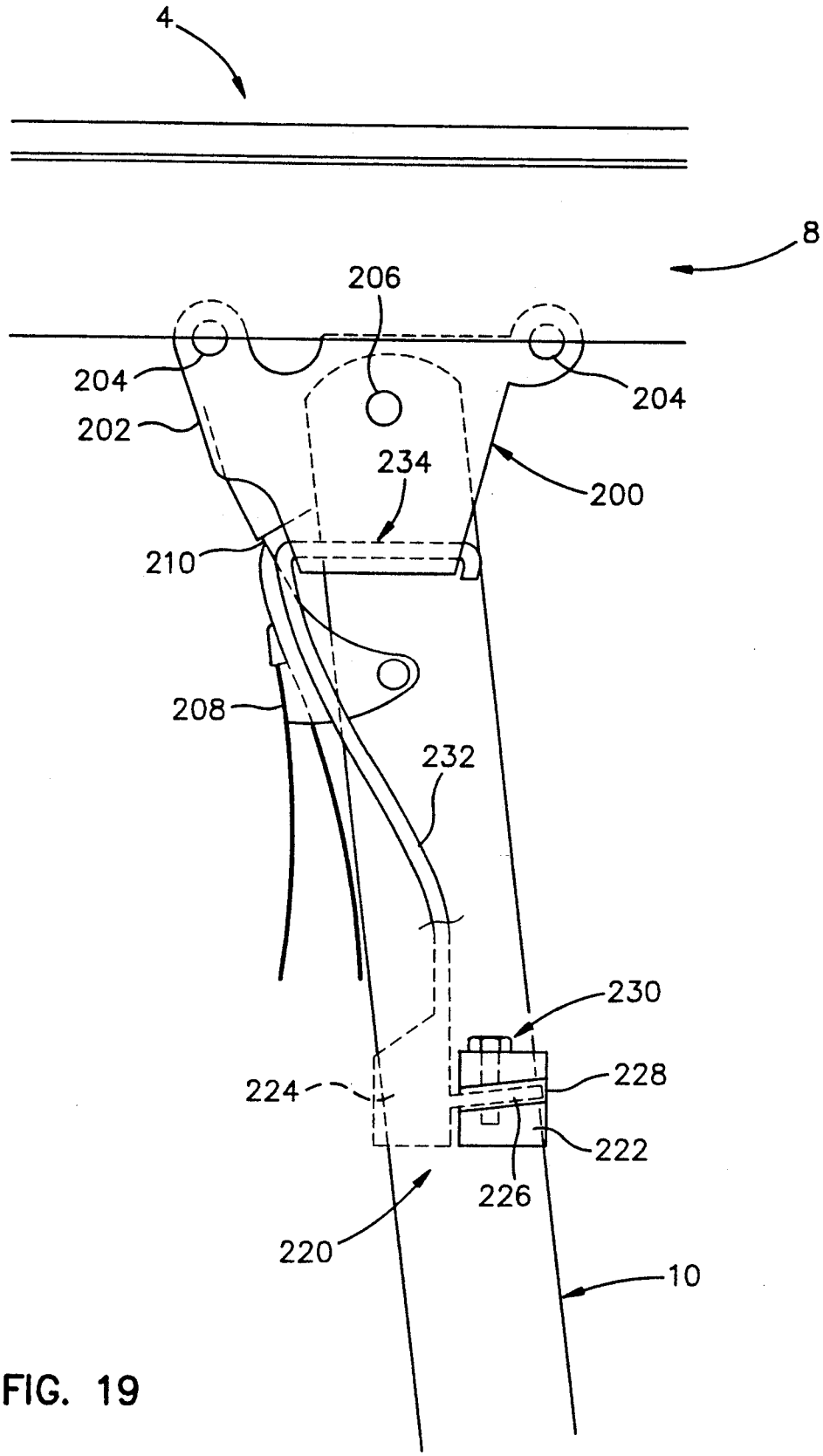
FIG. 19 is a partial side-elevation view of a food or beverage holder for use with an alternative table construction.
Figure 20:
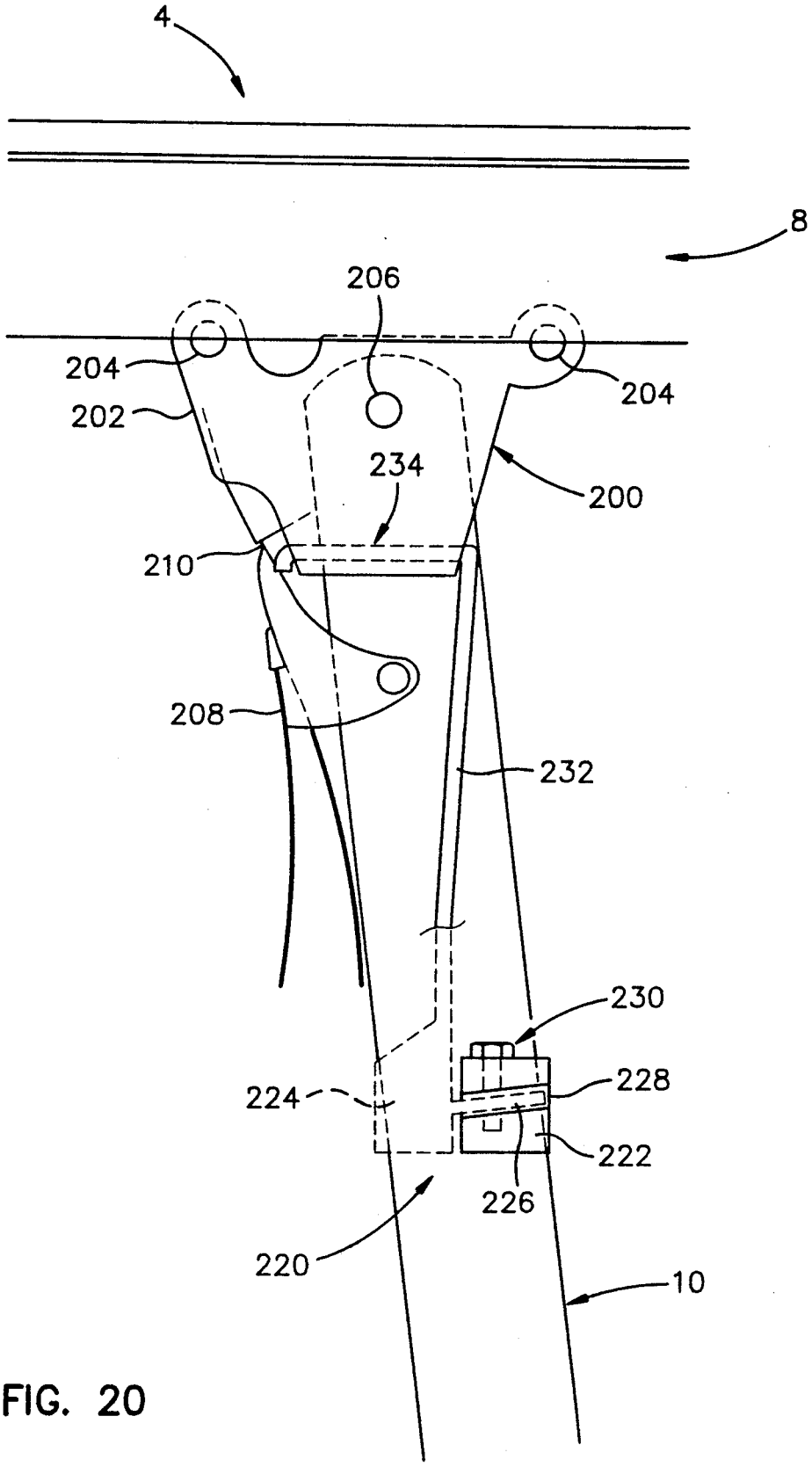
FIG. 20 is another partial side-elevation view of a food or beverage holder for use with an alternative table construction.
Figure 21:
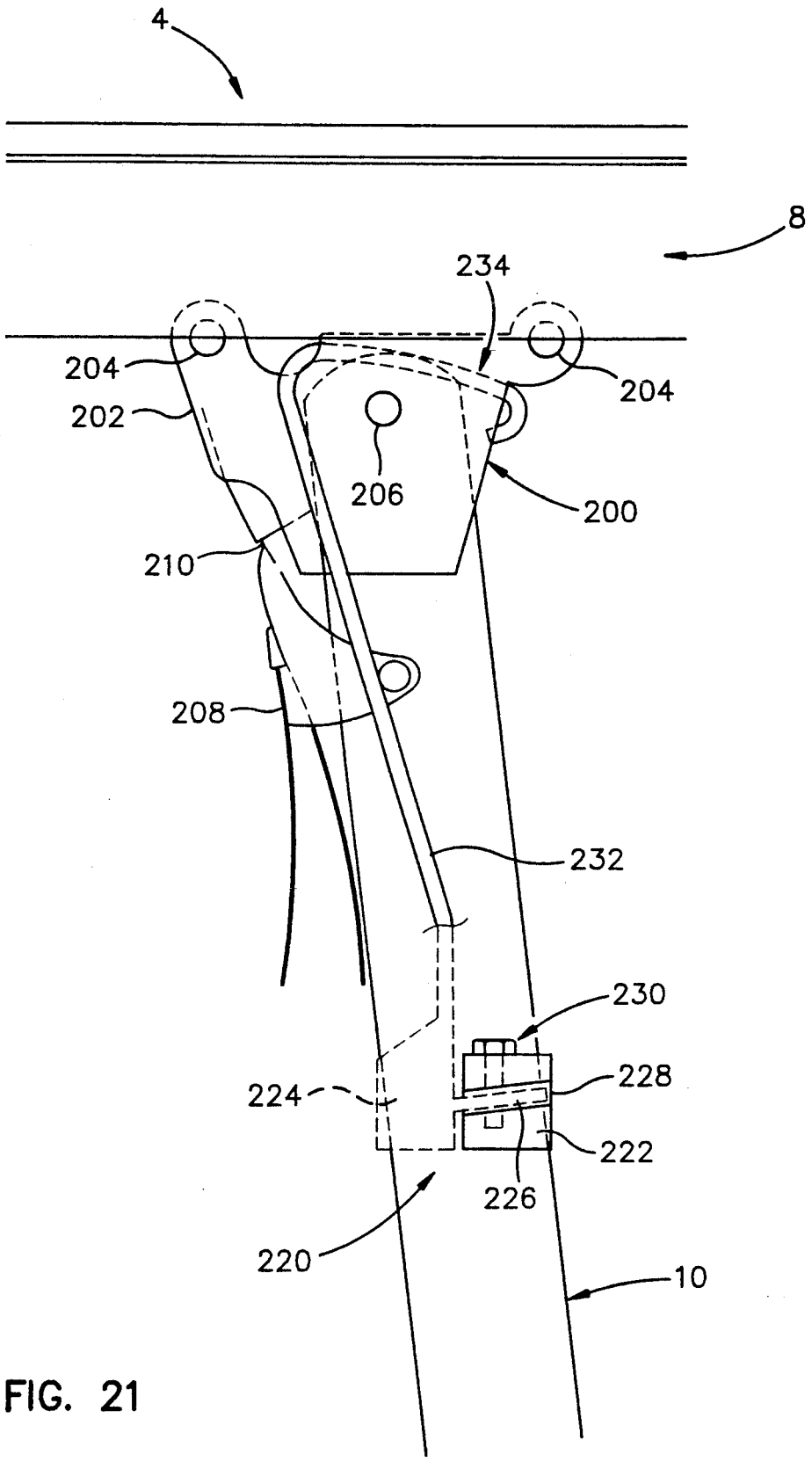
FIG. 21 is another partial side-elevation view of a food or beverage holder for use with an alternative table construction.
Figure 22:
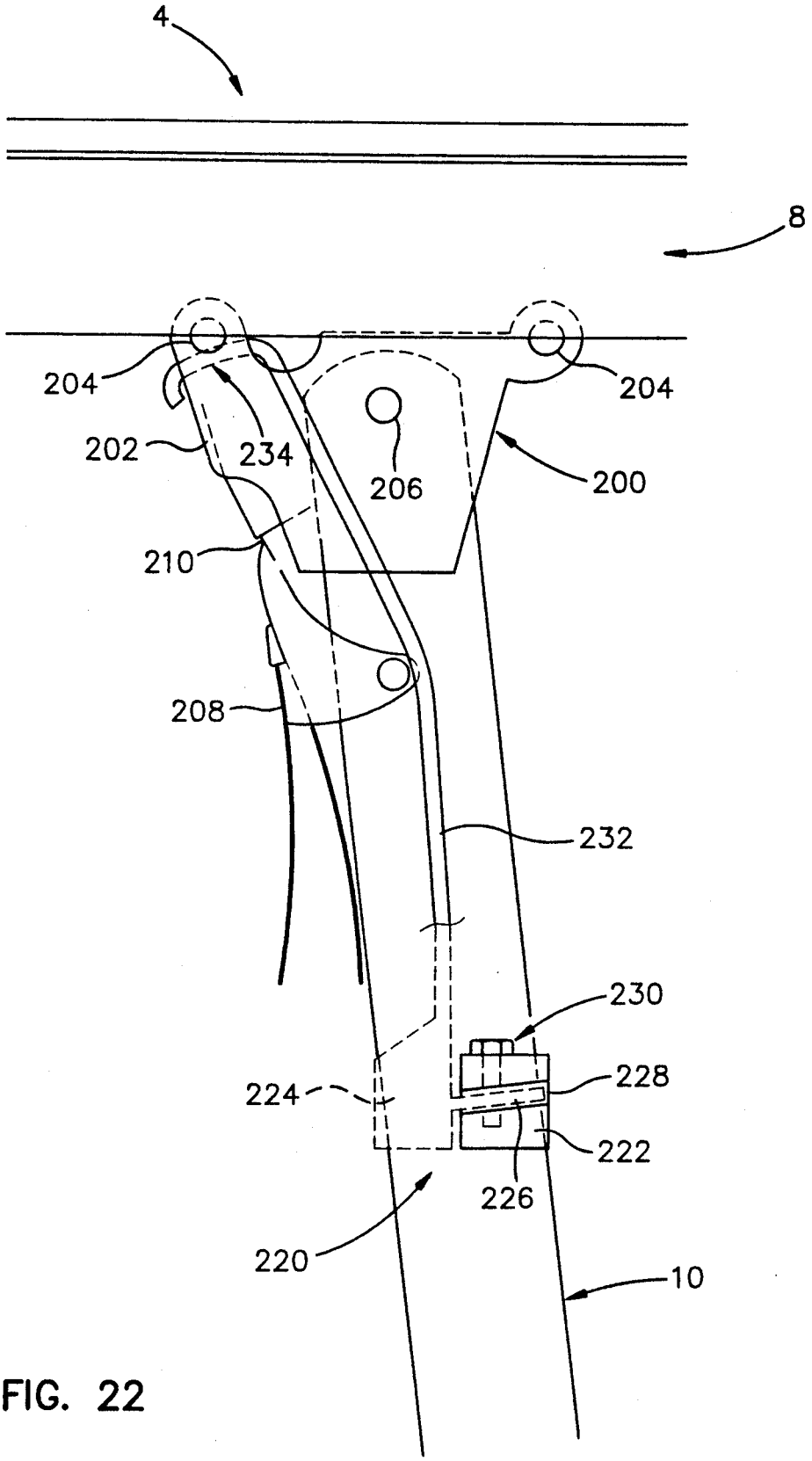
FIG. 22 is another partial side-elevation view of a food or beverage holder for use with an alternative table construction.

Referring now to FIG. 19, the card table 4 is shown as having a different table leg assembly 200 that includes a metal bracket 202 mounted to the peripheral table top railing 8 by a pair of rivets or other suitable fasteners 204. The table leg 10 is pivotally mounted to the bracket 202 using a rivet or other suitable fastener 206. The table leg 10 has mounted thereto a pivotable clasp member 208. The clasp member 208 is used to maintain the table leg 10 in an open use position by engaging a stop surface 210 located on the bracket 202. When it is desired to pivot the leg 10 to a folded storage position, the clasp 208 is pivoted out of engagement with the stop surface 210. It will be observed that the table leg 10 is non-vertical. This is fairly common in some card tables and the angle of the leg may actually vary widely among tables.

A food and/or beverage holding device 220 is partially illustrated in FIGS. 19-22 as being horizontally positioned and mounted to the card table 4 by way of the bracket 202. The holder 220 includes a food or beverage holder (not shown) which could include any of the flat platforms or ring-shaped holders and container receptacles illustrated in FIGS. 1, 5, 6 or 11. The device 220 further includes a base 222 extending radially away from the holder and removably mounted thereto. A table leg receptacle, which could be formed like the table leg receptacle 88 described above, or like the table leg receptacle 314 to be described below, is mounted to the base 222. Preferably, the base 222 is removably mounted to the table leg receptacle. The table leg receptacle can be sized to non-graspingly yet closely encompass more than 180 degrees of the card table's non-vertical leg 10 to limit side to side and front to back beverage movement that might cause beverage spillage. Alternately, the table leg receptacle could encompass less than, or about, 180 degrees of the table leg 10. The table leg receptacle is also designed and shaped to assure a horizontally positioned holder. The base 222 is preferably mounted to an attachment hook assembly by means of a connector 226 that is slideably disposed in a slot 228 of the base 222 and retained in position using a removable pin 230. The attachment hook assembly includes at least one attachment hook 224, having a vertical extension 232 that extends upwardly from the base 222 for separately engaging a portion of the table leg assembly 200. The attachment hook vertical extension 232 extends upwardly from the base 222 to a lateral hook portion 234 that engages the bracket member 202 at a selected portion thereof which may be any area that is suitable for hooking as illustrated in FIGS. 19–22. The base 222 the table leg receptacle and the attachment hook 232 are preferrably sized so that a beverage container need not contact the card table leg 10 or the card table leg assembly 200 during normal use of the device, as better shown in FIG. 25.

Figure 23:
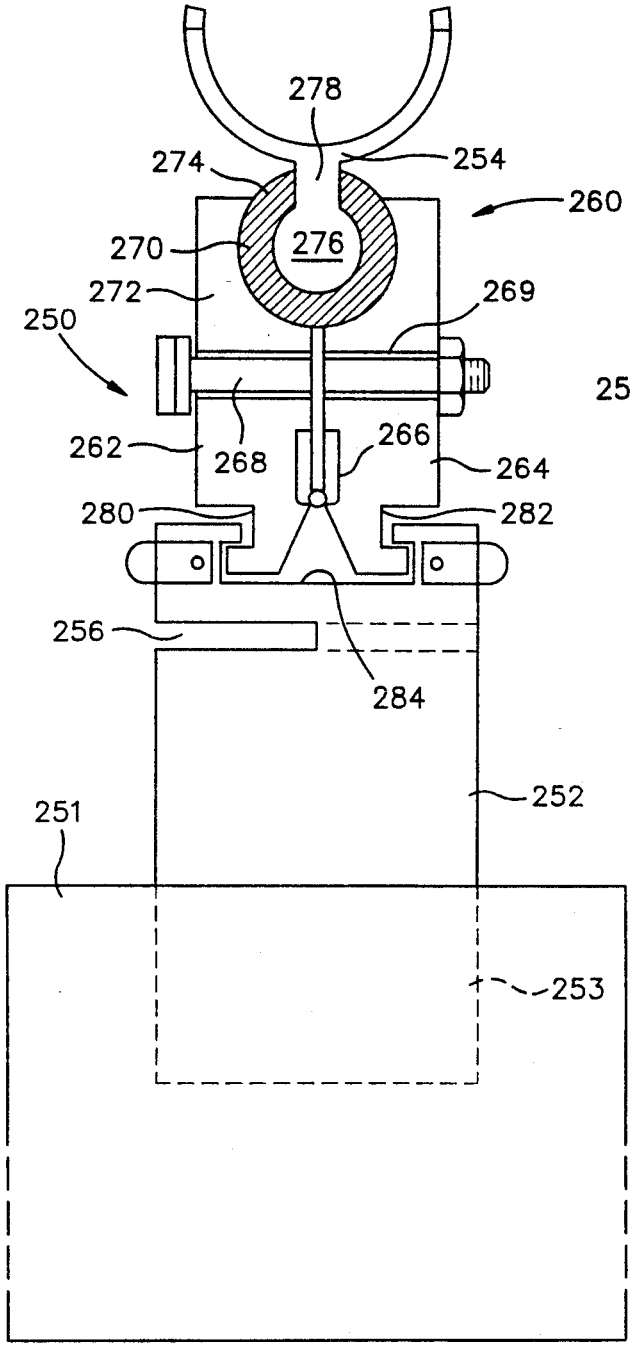
FIG. 23 is a detailed partial plan view of a food or beverage holder constructed in accordance with another aspect of the invention.
Figure 24:
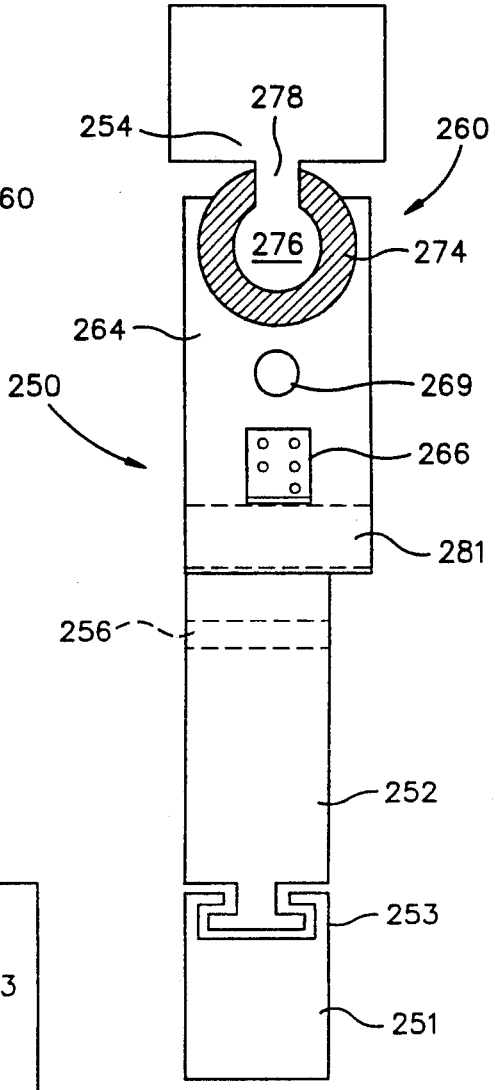
FIG. 24 is a detailed partial side view of the food or beverage holder of FIG. 23.

Turning now to FIGS. 23 and 24, an alternative food and/or beverage holding device 250 includes a food or beverage holder 251 which could include any of the flat platforms or ring-shaped holders and container receptacles illustrated in FIGS. 1, 5, 6 or 11. The device 250 further includes a base 252 extending radially away from the holder which may be removably mounted thereto as shown in FIGS. 23 and 24, and also as described below in relation to FIGS. 25 and 26. In FIGS. 23 and 24, the holder 251 is removably attached to the base 252 via an extension 253 protruding radially from the base 222. The extension 253 is shaped to slideably fit in a "C"-shaped opening in the holder 251. A table leg receptacle 254 is removably mounted to and extends radially away from the base 252. The table leg receptacle 254 is sized to non-graspingly yet closely encompass about 180 degrees of a card table leg, be it vertical or nonvertical, to limit beverage movement that might cause beverage spillage. At least one attachment hook 256 is removably mounted to the base 252 by means of a slot in the base 252. The attachment hook 256 (only a portion of which is shown) extends upwardly from the base 252 to engage a portion of a card table leg assembly. This engagement can be performed in any of the ways previously described in relation to other figures. The base 252 is preferably sized so that a beverage container need not contact a card table leg assembly or the attachment hook 256 during normal use.

Advantageously, the base 252 is adjustably mounted to table leg receptacle 254 to accomodate table legs oriented at virtually any angle and still provide a generally horizontal food or beverage holder. This adjustable mounting is provided by a connector assembly 260. The connector assembly includes a pair of clamp arms 262 and 264 that are pivotally joined at one end by a hinge 266. The clamp arms can be adjustably urged together by an adjuster 268 formed from a bolt and nut arrangement that is preferably hand operable without the use of tools. The adjuster 268 extends through an aperture 269 in the clamp arms 262 and 264. The clamp arms each include opposing semi-spherical recesses 270 and 272. When the clamp arms are urged together by the adjuster 268, these recesses form a spherical cavity that is sized to receive a resilient insert 274. The resilient insert, in turn, serves as a socket for a ball element 276 mounted to a stem 278 protruding radially from the table leg receptacle 254. A ball and socket connection is thus formed at the table leg receptacle. At the opposite end of the connector assembly, the clamp arms 262 and 264 each include an ear member 280 and 282, respectively. The ear members are slideably received in a slot with a bottom 284 in the base 252. The base 252 and the table leg receptacle 254 can be fixed relative to each other by tightening the adjuster 268 so that the clamp arms 262 and 264 firmly grasp the ball element 276 via the resilient insert 274. Loosening the adjuster 268 allows the base 252 and table leg receptacle 254 to be pivotally adjusted relative to each other so that the holder 251 can be maintained in a generally horizontal orientation despite changes in vertical orientation of a card table leg to which the device 250 is mounted.

Figure 25:
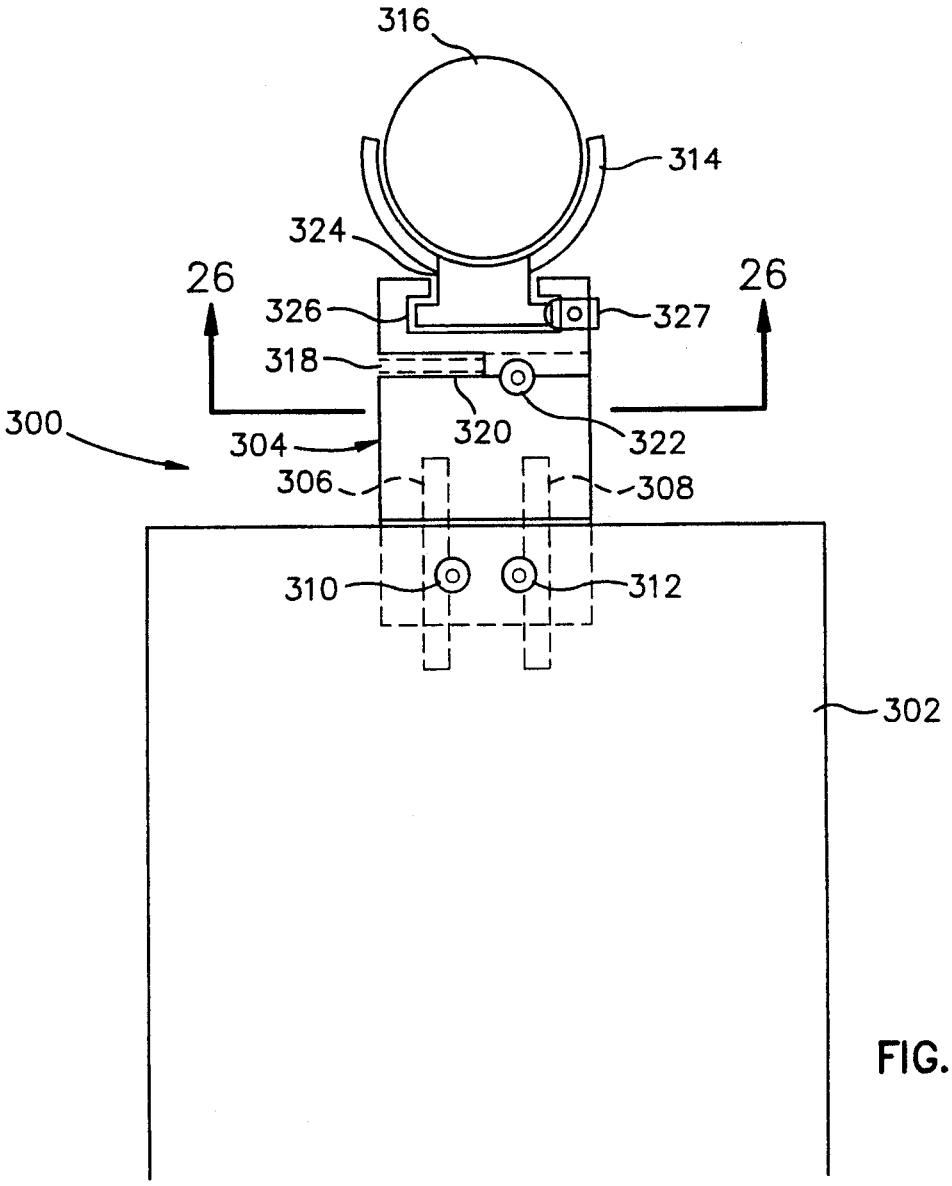
FIG. 25 is plan view of a food or beverage holder constructed in accordance with another aspect of the invention.
Figure 26:
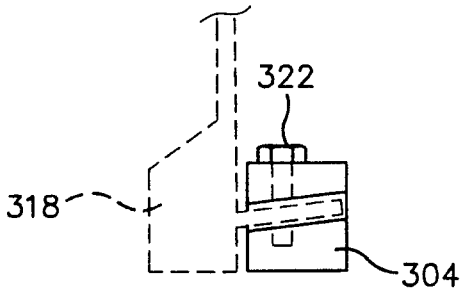
FIG. 26 is a cross-section view taken along line 26—26 in FIG. 25.

Referring now to FIGS. 25 and 26, another alternative food and/or beverage holding device 300 is adapted for table legs having circular cross-sections and vertical or nonvertical orientations. The device 300 includes a food or beverage holder 302 which is shown as being a horizontal platform but could also include any of the flat platforms or ring-shaped holders and container receptacles illustrated in FIGS. 1, 5, 6 or 11. The device 300 further includes a base 304 extending radially away from the holder 302 and removably mounted thereto. The base 304 is removably mounted to the holder 302 by way of a pair of pins 306 and 308 positioned in corresponding recesses in the base 304 and holder 302. Alternatively, the pins 306 and 308 could be formed to be integral with and extend from either of the base or the holder and to be received and fastened in a corresponding recess in the other component. FIG. 25, for example, shows the pins 306 and 308 being fixed to the base 304 and received in the holder 302. The pins 306 and 308 are connected using removable fasteners 310 and 312, which may be of conventional design.

A table leg receptacle 314 is removably mounted to and extends radially away from the base 304. The table leg receptacle 314 is sized to non-graspingly yet closely encompass a substantial portion of the periphery of a circular card table leg 316. The leg 316 may be vertical or nonvertical. The table leg receptacle 314 is sized to limit beverage movement that might cause beverage spillage. At least one attachment hook 318 is removably mounted to the base 304 by means of a slot 320 in the base and a fastener 322 of conventional design. The attachment hook 318 (only a portion of which is shown) extends upwardly from the base 304 to engage a portion of a card table leg assembly. This engagement can be performed in any of the ways previously described in relation to other figures. The base 304 is preferably sized so that a beverage container need not contact a card table leg assembly or the attachment hook 318 during normal use. The device also accommodates nonvertical legs through the provision of a removable connection between the table leg receptacle 314 and the base 304. The removable connection is provided by a connector 324 extending radially outwardly from the table leg receptacle 314, and a corresponding slot having a bottom 326 in the base 304. A fastener 327 of conventional design may be turned over a corner of the connector 324 to hold the connector in the slot when desired. With this removable connection it is possible to provide a single base and holder with a kit of multiple table leg receptacles, each designed for a different table leg angle. Thus, the holder 302 can be maintained in a generally horizontal orientation despite changes in vertical orientation of the table leg 316.

Figure 27:
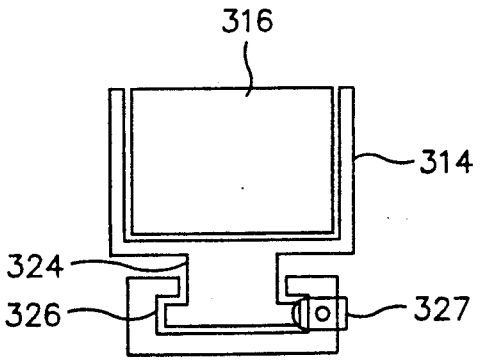
FIG. 27 is a partial plan view of a food or beverage holder constructed in accordance with another aspect of the invention.

FIG. 27 illustrates an alternative implementation of the food and/or beverage holding device 300 providing a generally square table leg receptacle 314 for engaging a card table leg 316 having a non-circular (square) cross-section.

Thus, an improved food and/or beverage holding system has been disclosed wherein one or more major members are removably constructed for separation from the remainder of the apparatus, to enhance portability. While I have described several preferred embodiments of my card-table mounted food and beverage holder apparatus, it should be understood that modifications and adaptations thereof will occur to persons skilled in the art. Therefore, the protection afforded my invention should not be limited except in accordance with the spirit of the following claims and their equivalents.

I claim:

1. A food and/or beverage container holding system for mounting on a card table having a vertical or non-vertical leg assembly, comprising:

a food and/or beverage container holder;

a base extending radially away from said and removably mounted thereto;

a table leg receptacle removably mounted to and extending radially away from said base, said table leg receptacle being sized to encompass a portion of card table leg assembly to limit beverage movement that might cause beverage spillage;

at least one attachment hook extending removably and upwardly from said base for separately engaging a portion of the card table leg assembly; and said base being sized to prevent beverage container contact with the card table leg assembly or said attachment hook during normal use of the food and/or beverage container holding system.

2. The system of claim 1 further including means for maintaining said food and/or beverage holder in a generally horizontal orientation despite changes in vertical orientation of the card table leg assembly.

3. A food and/or beverage container holding system for mounting on a card table having a vertical or non-vertical leg assembly, comprising:

a food and/or beverage container holder;

a base extending radially away from said holder and mounted thereto;

a table leg receptacle mounted to and extending radially away from said base, said table leg receptacle being sized to non-graspingly yet closely encompass a portion of the card table leg assembly to limit beverage movement that might cause beverage spillage;

at least one attachment hook extending upwardly from said base for separately engaging a portion of the card table leg assembly; and said base being sized to prevent beverage container contact with the card table leg assembly or said attachment hook during normal use of the food and/or beverage container holding system.

4. The system of claim 3 further including means for maintaining said food and/or beverage holder in a generally horizontal orientation despite changes in vertical orientation of the card table leg assembly.

5. A food and/or beverage container holding system for mounting on a card table having a vertical or non-vertical leg assembly, comprising:

a food and/or beverage container holder;

a base extending radially away from said holder and mounted thereto;

a table leg receptacle removably mounted to and extending radially away from said base, said table leg receptacle being sized to encompass about 180 degrees of the/card table leg assembly to limit side to side and front to back beverage movement that might cause beverage spillage;

at least one attachment hook extending upwardly from said base for separately engaging a portion of the card table leg assembly; and said base being sized to prevent beverage container contact with the card table leg assembly or said attachment hook during normal use of the food and/or beverage container holding system.

6. The system of claim 5 further including means for maintaining said food and/or beverage holder in a generally horizontal orientation despite changes in vertical orientation of the card table leg assembly.

7. A food and/or beverage container holding system for mounting on a card table having a vertical or non-vertical leg assembly, comprising:

a food and/or beverage container holder;

a base extending radially away from said holder and mounted thereto;

a table leg receptacle removably mounted to and extending radially away from said base, said table leg receptacle being sized to encompass less than about 180 degrees of the card table leg assembly to limit side to side beverage movement that might cause beverage spillage;

at least one attachment hook extending upwardly from said base for separately engaging a portion of the card table leg assembly; and said base being sized to prevent beverage container contact with the card table leg assembly or said attachment hook during normal use of the food and/or beverage container holding system.

8. The system of claim 7 further including means for maintaining said food and/or beverage holder in a generally horizontal orientation despite changes in vertical orientation of the card table leg assembly.

9. A food and/or beverage container holding system for mounting on a card table having a vertical or non-vertical leg assembly, comprising:

a food and/or beverage container holder;

a base extending radially away from said holder and mounted thereto;

a table leg receptacle removably mounted to and extending radially away from said base, said table leg receptacle being sized to encompass more than about 180 degrees of the card table leg assembly to limit side to side and front to back beverage movement that might cause beverage spillage;

at least one attachment hook extending upwardly from said base for separately engaging a portion of the card table leg assembly; and said base being sized to prevent beverage container contact with the card table leg assembly or said attachment hook during normal use of the food and/or beverage container holding system.

10. The system of claim 9 further including means for maintaining said food and/or beverage holder in a generally horizontal orientation despite changes in vertical orientation of the card table leg assembly.

11. A food and/or beverage container holding system for mounting on a card table having a vertical or non-vertical leg assembly, comprising:

a food and/or beverage container holder;

a base extending radially away from said holder and mounted thereto;

a table leg receptacle removably mounted to and extending radially away from said base, said table leg receptacle being sized to encompass a portion of the card table leg assembly to limit beverage movement that might cause beverage spillage;

at least one attachment hook extending removably and upwardly from said base for separately engaging a portion of the card table leg assembly;

levelling means for maintaining said food and/or beverage holder in a generally horizontal orientation despite changes in vertical orientation of the card table leg assembly; and said base being sized to prevent beverage container contact with the card table leg assembly or said attachment hook during normal use of the food and/or beverage container holding system.

12. The system of claim 11 wherein said levelling means includes a kit having a plurality of table leg receptacles of different vertical orientations, said table leg receptacles being selectively mountable to said base.

13. The system of claim 11 wherein said levelling means includes an adjustable clamping system extending radially between said base and said table leg receptacle.

14. The system of claim 13 wherein said adjustable clamping system provides a ball and socket connection between said base and said table leg receptacle.

15. The system of claim 13 wherein said adjustable clamping system includes a pair of hinged clamping arms at one end for clamping onto a ball element mounted on said table leg receptacle and at the other end to said base.

16. The system of claim 15 wherein said clamping arms are configured to receive an adjustment fastener used to impart a clamping force to clamp said clamping arms on said ball element.

17. The system of claim 15 further including a resilient sleeve disposed between said clamping arms and said ball element.

18. The system of claim 15 wherein said clamping arms include projections that are slideably mounted to said base.

19. The system of claim 18 wherein said clamping arms are hinged adjacent to said projections.

20. The system of claim 11 wherein said table leg receptacle is configured to encompass card table leg assemblies having a non-circular cross-section.

21. A food and/or beverage container holding system for mounting on a card table having a vertical or non-vertical leg assembly, comprising;

a food and/or beverage container holder;

a base extending radially away from said holder and mounted thereto;

a table leg receptacle mounted to and extending radially away from said base, said table leg receptacle being sized to encompass a portion of the card table leg assembly to limit beverage movement that might cause beverage spillage;

at least one attachment hook extending upwardly from said base for separately engaging a portion of the card table leg assembly;

said base being sized to prevent beverage container contact with the card table leg assembly or said attachment hook during normal use of the food and/or beverage container holding system; and one or more of said holder, said base, said table leg receptacle and said attachment hook being removably constructed for separation from the remainder of the food and/or beverage container holding system, to enhance portability.

* * * * *

UNITED STATES PATENT AND TRADEMARK OFFICE

CERTIFICATE OF CORRECTION

PATENT NO. : 5,285,991

DATED : February 15, 1994

INVENTOR(S) : Arthur E. Carlson

It is certified that error appears in the above-indentified patent and that said Letters Patent is hereby corrected as shown below:

On title page, item [73] delete "Arthur E. Carlson, San Diego, Calif."
insert --Arthur E. Carlson, Trustee, UDT, August 15, 1986--

Signed and Sealed this

Fourteenth Day of June, 1994

*Attest:*

*Attesting Officer*

BRUCE LEHMAN

*Commissioner of Patents and Trademarks*